US005198102A

United States Patent [19]

Kaul et al.

[11] Patent Number: 5,198,102

[45] Date of Patent: Mar. 30, 1993

[54] BENZENE REMOVAL FROM A HEARTCUT FRACTION OF GASOLINE BOILING RANGE STREAMS

[75] Inventors: Bal K. Kaul, Randolph; Joseph T. O'Bara, Parsippany; David W. Savage, Lebanon; J. Patrick Dennis, Chatham, all of N.J.

[73] Assignee: Exxon Research and Engineering Company, Florham Park, N.J.

[21] Appl. No.: 729,679

[22] Filed: Jul. 15, 1991

[51] Int. Cl.[5] ..... C07C 7/12; C10G 25/00; C10G 25/03

[52] U.S. Cl. ..... 208/310 Z; 585/827

[58] Field of Search ..... 208/310 Z; 585/827

[56] References Cited

U.S. PATENT DOCUMENTS

| | | | |
|---|---|---|---|
| 2,728,800 | 12/1955 | Manne et al. | 585/827 |
| 2,856,444 | 10/1958 | Pollock | 585/827 |
| 4,159,284 | 6/1979 | Seko et al. | 585/825 |
| 4,778,946 | 10/1988 | Hulme et al. | 585/828 |

FOREIGN PATENT DOCUMENTS

| | | | |
|---|---|---|---|
| 0055123 | 4/1980 | Japan | 585/827 |

*Primary Examiner*—Theodore Morris
*Assistant Examiner*—Zeinab El-Arini
*Attorney, Agent, or Firm*—Henry E. Naylor

[57] ABSTRACT

A method for selectively separating benzene from gasoline boiling range streams by first fractionating the stream to produce a $C_6$ heartcut fraction which is then passed to an adsorption zone comprised of a bed of solid adsorbent material capable of selectively removing benzene from the stream. The absorbent is regenerated with a suitable desorbent, preferably toluene.

16 Claims, 1 Drawing Sheet

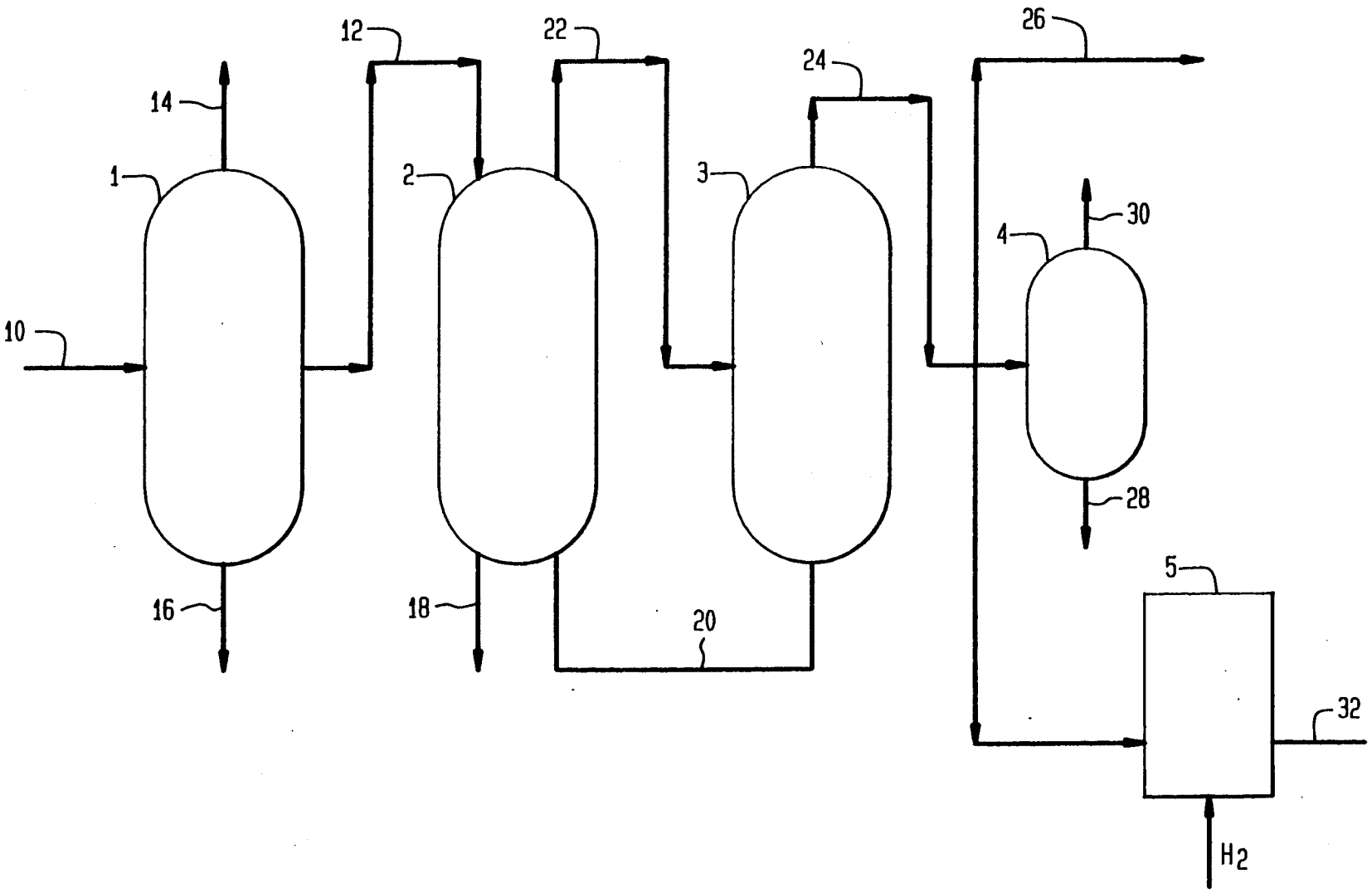
10
1
14
16
12
2
18
22
3
20
24
4
30
28
26
5
32
H2

BENZENE REMOVAL FROM A HEARTCUT FRACTION OF GASOLINE BOILING RANGE STREAMS

FIELD OF THE INVENTION

The present invention relates to the production of gasoline boiling range streams which are substantially reduced in benzene. The gasoline boiling range stream is first fractionated to produce a heartcut fraction which contains substantially all of the benzene from the feedstock. This heartcut stream is passed to an adsorption zone containing a solid adsorbent, such as a NaX or NaY zeolite, to selectively adsorb benzene from the stream. The adsorbent can be regenerated by desorbing the benzene with a suitable desorbent, such as toluene.

BACKGROUND OF THE INVENTION

Motor gasoline formulations are expected to change in order to meet ever restrictive governmental regulations and competition from alternative fuels, such as methanol. One requirement for future gasolines is that they be substantially reduced in benzene content.

While various techniques can be used to selectively remove benzene from gasoline boiling range streams, the use of solid adsorbents, such as molecular sieves, presents advantages over other techniques such as distillation and solvent extraction. Distillation is not suitable primarily because benzene, which has a normal boiling point of about 176° F., forms low boiling azeotropes with normal hexane and naphthenes, such as methyl cyclopentane and cyclohexane. Efficient separation of the benzene from the paraffinic compounds by distillation is not possible because the azeotropes tend to come overhead with the paraffinic compounds. These azeotropes boil in the same range as does normal hexane in a light naphtha cut, i.e., 150° to 160° F. Once the benzene is removed, this separation is simplified. Extraction with a solvent, such as sulfolane, is technically feasible, but presents some disadvantages. These disadvantages include the use of special equipment to compensate for the corrosive nature of sulfolane, and the appearance of sulfur impurities in the gasoline product.

Solid adsorbents have been used in the past for removing all the aromatics from the non-aromatic fraction of a mixed hydrocarbon stream. For example, U.S. Pat. No. 2,716,144 teaches the use of silica gel for separating all aromatics from gasoline or kerosene fractions. The silica gel containing adsorbed aromatics can then be desorbed with a suitable desorbent, such as an aromatic containing hydrocarbon, having a boiling point different than the benzene-containing process stream which is passed over the adsorbent. Other U.S. patents which teach the use of silica gel for adsorbing aromatics from a process stream, followed by desorption by use of a liquid hydrocarbon include U.S. Pat. Nos. 2,728,800; 2,847,485; and 2,856,444.

The separation of aromatics from process streams by use of a molecular sieve is taught in U.S. Pat. No. 3,963,934. In that patent a 13X molecular sieve is taught to adsorb not only aromatics, but also olefins and sulfur from a $C_5/C_6$ naphtha stream prior to isomerization. U.S. Pat. No. 3,992,469 also teaches the use of molecular sieves for separating all aromatics from process streams. Type X and type Y crystalline aluminosilicate zeolites are taught as preferred molecular sieves. Also, U.S. Pat. No. 4,014,949 discloses that partially hydrated NaY gives a separation factor of 1.6 for benzene (adsorbed) with toluene.

While much work has been done to separate aromatics from non-aromatics in process streams, there is still a need in the art for selectively removing benzene from both the other aromatic and the non-aromatic components of the stream. The need to remove benzene from gasoline boiling range streams will be more critical in the future because of more stringent government requirements.

SUMMARY OF THE INVENTION

In accordance with the present invention, there is provided a process for selectively removing benzene from gasoline boiling range process streams. The process comprises:

(a) fractionating a gasoline boiling range hydrocarbonaceous process stream such that one of the fractions is a heartcut fraction, having an average boiling point from about 120° F. to about 190° F., and which contains a higher concentration of benzene than the original stream or any of the other fractions;

(b) passing the heartcut fraction to an adsorption zone containing a solid adsorbent comprised of an aluminosilicate zeolite material having a silica to alumina ratio of less than about 3, and an average pore diameter greater than the size of the benzene molecule;

(c) passing a desorbent capable of desorbing benzene from the adsorbent and having an average boiling point which is at least 10° F. different from the boiling point of benzene, through the bed of benzene-containing adsorbent in the adsorption zone, thereby removing benzene from the adsorbent;

(d) passing the benzene-containing desorbate to a distillation zone to separate benzene from the desorbent, thereby resulting in a benzene rich stream and a desorbent stream; and (e) recycling the desorbent stream back to the adsorption zone.

In a preferred embodiment of the present invention, the benzene-rich stream is passed to a distillation zone wherein benzene is separated from any lighter boiling components.

In another preferred embodiment of the present invention, the desorbent stream already exists in the refinery or chemical plant and may be passed directly to the adsorption zone.

In yet another preferred embodiment of the present invention, the zeolite material is a 12 ring or greater zeolite selected from:

(a) Zeolite L framework (code LTL) containing Group IA cations (lithium, sodium, potassium, rubidium, cesium) or mixtures thereof.

(b) Zeolite X framework (code FAU) containing Group IA cations or mixtures thereof.

(c) Zeolite Y framework (code FAU) containing Group IA cations or mixtures thereof.

(d) Zeolite mordenite framework (code MOR) containing Group IA cations or mixtures thereof.

The zeolite framework codes are taken from the publication "The Zeolite Cage Structure" by J. M. Mervsam, Science, Mar. 7, 1986, Volume 231, pp 1093-1099, which is incorporated herein by reference.

In still another preferred embodiment of the present invention, the zeolite material is NaX or NaY, particularly those which are at least partially dehydrated, and the desorbent is selected from toluene, xylene, a refinery process stream, or mixtures thereof.

BRIEF DESCRIPTION OF THE FIGURES

FIG. 1 hereof is a simplified flow diagram of the process of the present invention.

DETAILED DESCRIPTION OF THE INVENTION

Process streams on which the present invention can be practiced include those in the gasoline boiling range. In general, the gasoline boiling range can be considered to be in the temperature range of about 80° F. to 375° F., preferably about 100° F. to 375° F. Preferred process streams include reformates and hydrocrackates, especially reformates. Other streams could be cracked naphtha, hydrotreated cracked naphtha.

Turning now to FIG. 1, a preferred flow scheme is shown wherein a gasoline boiling range process stream is fed via line 10 into distillation zone 1. The distillation zone is comprised of a distillation column which fractionates the stream into at least three streams, one of which is a $C_6$ heartcut stream in the boiling range of about 120° F. to about 190° F. The $C_6$ hearthcut stream is passed via line 12 to adsorption zone 2. A light gasoline stream, having an average boiling point less than about 140° F., is collected overhead via line 14 and a heavier gasoline blending stream, having an average boiling point of about 210° F. and above, is collected via line 16.

The adsorption zone is operated at any suitable set of conditions, preferably including the temperature of the feedstream, which will typically be from about ambient temperatures (70° F.) to about 300° F. The adsorption zone can be comprised of only one adsorption vessel, or two separate vessels as depicted in the sole figure hereof. It can also be comprised of three or more vessels with the appropriate plumbing for the continuous regeneration of the adsorbent. The adsorption/desorption zone can be run under any suitable mode, examples of which include fixed bed, moving bed, simulated moving bed, and magnetically stabilized bed. The product stream which leaves the adsorption zone via line 18 is a substantially benzene-free gasoline boiling range stream.

The solid adsorbent is a cation exchanged zeolitic material which is capable of selectivity adsorbing benzene from the stream. Preferably, the zeolite adsorbents of the present invention: (a) have a silica to alumina ratio of less than 10, especially from 1 to 3; (b) an average pore diameter from about 6 to 12 Angstroms (Å), preferably from about 6 to 8 Å; and (c) having a separation factor greater than 1 for benzene versus toluene. That is, it will have a preference for adsorbing benzene than it will for adsorbing toluene. The cation is selected from alkali metals: lithium, sodium, potassium, rubidium and cesium. Preferred is sodium. Preferred cation exchanged zeolites are the 12 ring or greater zeolites. Non-limiting examples of such zeolites include: L-type zeolites, X-type zeolites, Y-type zeolites, and mordenite type zeolites, all of which contain one or more different Group IA cation. By "L-type" zeolite is meant those zeolites which are isostructual zeolite L. The same holds true for the X-type, Y-type, and mordenite-type. That is, the X-type zeolites are isostrutual to zeolite X, etc.

Preferred is NaY. Especially preferred zeolites are those that are at least partially dehydrated. They can be dehydrated by calcining them at an effective temperature and for an effective amount of time. Effective temperatures will generally be from about 200° F. to 300° F., preferably from about 300° F. to 400° F., and more preferably from about 400° F. to 500° F. An effective amount of time will be for a time which will be effective at reaching the desired level of dehydration at the temperature of calcination. Generally this amount of time will be from 1 to 4 hours, preferably from about 2 to 3 hours.

The solid adsorbent is regenerated by treating it with a suitable desorbent. Suitable desorbents are organic solvents, both aromatic and non-aromatic, which have a boiling point different from that of benzene by at least 10° F., preferably by at least 20° F. Preferred desorbents are aromatic solvents, more preferred are toluene and xylene, and most preferred is toluene. It is also to be understood that refinery streams, having substantial concentrations of such aromatic solvents can also be used. These streams can also be withdrawn from process tower vessels, such as a hydrocracker distillation tower. The stream can also be obtained from a BTX recovery plant thereby simplifying the desorbent recovery process. The desorbent enters the adsorption zone via line 20 where it contacts the benzene-containing adsorbent and desorbes the benzene. The desorbent can be either a liquid or vapor, with liquid being preferred.

The desorbent, which now carries the desorbed benzene, leaves the adsorption zone via line 22 and is passed to distillation zone 3 where a benzene-rich stream is separated from the desorbent and passed via line 24 to one of three process options. One option would be to collect the benzene-rich stream as is, via line 26, which can be sent to existing extraction facilities. Another option would be to pass the benzene-rich stream to a distillation zone 4 where benzene is separated from any lighter components, thereby collecting a substantially pure, chemical grade, benzene stream via line 28. The lighter components can then be recycled via line 30 to the adsorption zone. The third option is to pass the benzene-rich stream to hydrogenation zone 5, where the benzene is hydrogenated to cyclohexane, or converted to toluene. The cyclohexane, or toluene, can be collected via line 32. The regenerated desorbent is recycled via line 20 to the adsorption zone. The difference in boiling point between the desorbed benzene and the desorbent, of course, allows for separation of the two components by distillation. It is understood that this particular process scheme is for the case when the desorbent has a higher boiling point than the desorbed benzene. Of course, the scheme would be different if the desorbent had a lower boiling point than benzene. In such a case, the desorbent would exit distillation zone 3 from the top and the benzene concentrate stream from the bottom.

Having thus described the present invention, and preferred embodiments thereof, it is believed that the same will become even more apparent by the examples to follow. It will be appreciated, however, that the examples are for illustrative purposes and are not intended to limit the invention.

EXAMPLE 1

Various cation-exchanged forms of zeolite L powder were contacted at 25° C. in sealed vials with a hydrocarbon mixture which contained 3.0 g. of benzene, 3.0 g. of toluene, 60.0 g. of decalin and 2.0 g. of tritertiarybutyl benzene. The contacting was carried out by shaking the vials for a period of over 4 hours. This was long enough for the zeolite and hydrocarbon phases to come to equilibrium. The hydrocarbon phase was analyzed by gas chromatography before and after contacting with the zeolite. From the analyses, calculations were made of the zeolite separation factor for benzene versus toluene, and the zeolite capacity to adsorb benzene plus toluene.

Separation factor is defined as $$\alpha B/T = \frac{[(\text{benzene})/(\text{toluene})]_{in\ zeolite}}{[(\text{benzene})/(\text{toluene})]_{in\ solution}}$$

at equilibrium. Capacity is defined as weight percent benzene plus toluene on zeolite at equilibrium.

The following results were obtained:

TABLE I

| Zeolite | Si:Al Ratio | Capacity, Weight % | Separation Factor $\alpha$ B/T |
|---|---|---|---|
| LiL | 2.6 | 8 | 1.3 |
| KL | 2.6 | 2 | 1.6 |

This example shows that LiL and KL zeolites show a separation factor in favor of benzene adsorption over toluene, i.e., $\alpha B/T > 1.0$.

EXAMPLE 2

The experiment of Example 1 was repeated using various cation-exchanged forms of zeolite X powder. The results obtained are shown in Table II.

TABLE II

| Zeolite | Si:Al Ratio | Capacity, Weight % | Separation Factor $\alpha$ B/T |
|---|---|---|---|
| LiX | 1.5 | 7 | 5.5 |
| NaX | 1.0 | 20 | 1.4 |
| NzX | 1.5 | 18 | 1.0 |
| NaRbX | 1.5 | 6 | 10.0 |
| NaCsX | 1.5 | 8 | 3.0 |
| MgX | 1.5 | 14 | 1.4 |

This example shows that a number of X-type zeolites show a separation factor in favor of benzene adsorption in preference to toluene.

EXAMPLE 3

The experiment of Example 1 was repeated using various cation-exchanged forms of zeolite Y powder. The results obtained are shown in Table III.

TABLE III

| Zeolite | Si:Al Ratio | Capacity, Weight % | Separation Factor $\alpha$ B/T |
|---|---|---|---|
| LiY | 2.5 | 28 | 1.6 |
| KY | " | 17 | 1.5 |
| NaY | " | 17 | 2.9 |
| MgY | " | 19 | 1.2 |
| LiNaY | " | 15 | 1.3 |
| CsKY | " | 6 | 1.6 |
| RbKY | " | 16 | 1.2 |
| LiKY | " | 24 | 1.7 |
| NaLaY | " | 21 | 1.3 |

This example shows that a range of Y zeolites gives a selective separation of benzene versus toluene by adsorption. It also show that Y zeolite, with mixed cations, show a preference to adsorb benzene over toluene. Furthermore, the data show that NaY zeolite has a very favorable combination of capacity and separation factor.

EXAMPLE 4

The experiment of Example 1 was repeated using various cation-exchanged forms of zeolite Mordenite. The results obtained are shown in Table IV.

TABLE IV

| Zeolite | Si:Al Ratio | Capacity, Weight % | Separation Factor $\alpha$ B/T |
|---|---|---|---|
| Li MOR | 6.2 | 6 | 1.9 |
| Cs MOR | 6.2 | 8 | 1.6 |

This example shows that mordenites also preferentially adsorb benzene over toluene.

COMPARATIVE EXAMPLE

The experiment of Example 1 was followed except several other zeolites were used. The zeolites used and the results obtained are shown in Table V.

TABLE V

| Zeolite | Si:Al Ratio | Capacity, Weight % | Separation Factor $\alpha$ B/T |
|---|---|---|---|
| ZSM-5 | 3 | 5 | 0.33 |
| $Cu^{+2}Y$ | 2.5 | 8 | 0.38 |
| LiLZ-210 | ~5 | 16 | ~1 |
| BaECR-32* | ~6 | 16 | ~0.6 |

*ECR-32 is a faujasite type of zeolite and its description is found in U.S. Patent No. 4,931,267 which is incorporated herein by reference.

The above table evidences that not all zeolites are selective for the adsorption of benzene over toluene.

EXAMPLE 5

A feed comprised of 10 wt. % benzene and the remainder being methylcyclopantane (MCP), which represents a heartcut fraction of a gasoline boiling range steam, was passed through an adsorption column comprised of a bed of 300 g. NaX zeolite adsorbent at room temperature. Samples of treated feed, as it exited the column, were analyzed in time intervals indicated in Table V below for the individual components of the feed.

TABLE V

| Time, Min. | Benzene, Wt. % | MCP, Wt. % |
|---|---|---|
| 5 | | 100 |
| 10 | 0 | 100 |
| 20 | 0 | 100 |
| 30 | 0 | 100 |
| 40 | 0 | 100 |
| 50 | 0 | 100 |
| 60 | 0.01 | 99.99 |
| 62 | 0.1 | 99.99 |
| 64 | 1.6 | 98.4 |
| 65 | 3.0 | 97.0 |
| 66 | 7.0 | 93.0 |
| 68 | 9.0 | 91.0 |
| 70 | 9.3 | 90.7 |
| 75 | 10.0 | 90.0 |

The adsorbent was desorbed by passing toluene through the bed of adsorbent at a flow rate of 20 cc/min and the concentration of benzene was monitored at the time intervals set forth in Table VII below.

TABLE VII

| Time, Min., | Benzene, Wt. % |
|---|---|
| 0 | 10 |
| 5 | 10 |
| 10 | 30 |
| 12 | 20 |

TABLE VII-continued

| Time, Min., | Benzene, Wt. % |
|---|---|
| 14 | 9 |
| 16 | 6 |
| 18 | 5 |
| 20 | 4 |
| 30 | 1 |
| 38 | 0 |
| 40 | 0 |

EXAMPLE 6

The procedure of Example 5 was followed except that the feed was a refinery stream (hydrocrackate) comprised of ~5 wt. % benzene and ~5 wt. % paraffins, isoparaffins, naphthene, etc. For the sake of simplicity the non-benzene portion of the feed is designated as paraffins. the results are set forth in Table VIII below.

TABLE VIII

| Time, Min. | Benzene, Wt. % | Paraffins Wt. % |
|---|---|---|
| 5 | 0 | 100 |
| 10 | 0 | 100 |
| 15 | 0 | 100 |
| 20 | 0 | 100 |
| 25 | 0 | 100 |
| 30 | 0 | 100 |
| 35 | 0 | 100 |
| 40 | 0 | 100 |
| 45 | 0 | 100 |
| 50 | 0.10 | 99.9 |
| 60 | 0.25 | 99.75 |
| 65 | 0.40 | 99.6 |
| 70 | 0.80 | 99.2 |
| 75 | 1.0 | 99.0 |
| 80 | 1.6 | 98.4 |
| 90 | 2.5 | 97.5 |
| 100 | 3.5 | 96.4 |
| 120 | 4.3 | 95.7 |
| 140 | 4.7 | 95.3 |
| 180 | 5.0 | 95.0 |

The adsorbent was desorbed by passing toluene through the bed of adsorbent at a flow rate of 20 cc/min and the concentration of benzene was monitored at the time intervals set forth in Table IX below.

TABLE IX

| Time, Min. | Benzene, Wt. % |
|---|---|
| 5 | 5 |
| 8 | 5 |
| 9 | 20 |
| 10 | 33 |
| 11 | 57 |
| 12 | 40 |
| 13 | 14.5 |
| 14 | 6 |
| 15 | 4.5 |
| 20 | 0.1 |
| 30 | 0 |
| 35 | 0 |
| 40 | 0 |

EXAMPLE 7

A sample of NaY zeolite were fully saturated with water by keeping it over a saturated solution of NaCl in a desiccator for 4 days. The sample was then calcined at a temperature of 100° C. for 2 hours and a portion was taken for benzene adsorption experiments, which will be discussed below. The remainder of the zeolite sample was then calcined at 200° C. for 2 hours and a sample taken for a benzene adsorption experiment. This procedure was repeated at 300° C., 400° C., and 500° C. The benzene adsorption experiments were conducted on a model mixture comprised of 60.06 g. of decalin(cis) as a solvent, 2.02 g. of tritertiary butyl benzene (TTBB) as an unadsorbed internal standard for gas chromatograph analyses, 3.03 g. benzene, and 3.02 g. toluene. This represented a 1/1 benzene/toluene mix. The pure liquids used to prepare the model mixture were dried thoroughly over zeolite 4A pellets and the TTBB, which was solid, was dried for one hour in a hot air oven at 35° C. The calcined zeolite samples were dried for 4 hours at 400° C. then transferred to a desiccator at 130° C. which had been purged with dry nitrogen. All weighing of zeolite samples were carried out in a balance case free of atmospheric moisture. New air tight vials were used to contain the zeolite and solution phases. The model mixture was contacted with the zeolite sample overnight at room temperature(about 22° C.). The model mixture phase and the zeolite phase were separated by filtration and a gas chromatographic analysis was performed with TTBB being the internal standard. The results of benzene adsorption are shown in Table X below.

TABLE X

| Calcination Temperature °C. | Benzene + Toluene Wt. % Adsorbed | Separation Factor $\alpha$ B/T |
|---|---|---|
| 100 | 9.4 | 1.3 |
| 200 | 18.8 | 2.7 |
| 300 | 18.6 | 2.7 |
| 400 | 17.3 | 2.9 |
| 500 | 17.8 | 2.8 |

EXAMPLE 8

The above conditions for the adsorption experiments were used to test the adsorption characteristics of NaY and NaX for selectively removing benzene from a model mixture containing benzene (B), toluene (T), and 1-methyl naphthalene (1-MN). The results are shown in Table XI below.

TABLE XI

| Zeolite | Benzene + Toluene + 1-Methyl Naphthalene, Wt. % Absorbed | Separation Factor B/T | Separation Factor B/1-MIN |
|---|---|---|---|
| NaX | 16.1 | 1.2 | 1.4 |
| NaY | 25.7 | 2.3 | 11.1 |

The above table shows that NaY zeolite is superior to NaX zeolite for selectively remaining benzene over 1-methyl naphthalene. Benzene and 1-methyl naphthalene compete approximately equally for NaX zeolite. These results are evidence that NaY zeolite is a absorbent of choice for benzene separation from a refinery stream which contains some alky naphthalenes, such as a reformate stream.

What is claimed:

1. A process for selectively separating benzene from gasoline boiling range process streams to produce substantially benzene free motor gasoline, the process comprising:

(a) fractionating a gasoline boiling range hydrocarbonaceous process stream such that one of the fractions is a heartcut fraction, having an average boiling point from about 120° F. to about 190° F., and which contains a higher concentration of benzene than the original stream or any of the other fractions;

(b) passing said heartcut fraction to an adsorption zone containing a solid adsorbent comprised of a cation- exchanged zeolite having; (i) silicon to aluminum ratio of less than about 10; (ii) an average pore diameter greater than the size of the benzene molecule; and (iii) a selectivity for benzene over toluene;

(c) passing a desorbent having a boiling point at least 10° F. different from the boiling point of benzene through the bed of benzene-containing adsorbent in the adsorption zone, thereby desorbing benzene from the adsorbent;

(d) passing the benzene-containing desorbate to a separation zone to separate benzene from the desorbent, thereby resulting in a benzene rich stream and a desorbent stream; and (e) recycling the desorbent stream back to the adsorption zone.

2. The process of claim 1 wherein the zeolite is a 12 ring, or greater zeolite.

3. The process of claim 2 wherein the zeolite is selected from the cation-exchanged: L-type zeolites, X-type zeolites, Y-type zeolites, and mordenite-type zeolites; and wherein one or more of the cations is selected from the group consisting of: lithium, sodium, potassium, rubidium, and cesium.

4. The process of claim 3 wherein the zeolite is selected from NaX and NaY.

5. The process of claim 4 wherein the zeolite is NaY which is at least partially dehydrated.

6. The process of claim 1 wherein the desorbent is an aromatic solvent having a boiling point at least 10° F. different from that of benzene.

7. The process of claim 6 wherein the desorbent is selected from toluene, xylene, and a refinery process stream which has a relatively high concentration of toluene or toluene and xylene.

8. The process of claim 7 wherein the desorbent is toluene.

9. The process of claim 4 wherein the desorbent is selected from toluene, xylene, and a refinery process stream which has a relatively high concentration of toluene or toluene and xylene.

10. The process of claim 9 wherein the desorbent is toluene.

11. The process of claim 9, wherein the benzene-rich stream from step (d) is passed to another distillation zone where a substantially pure benzene fraction is separated from lighter components.

12. The process of claim 7 wherein the benzene-rich stream from step (d) is passed to another distillation zone where is substantial pure benzene fraction is separated from lighter components.

13. The process of claims 7 wherein the benzene-rich stream of step (d) is passed to a hydrogenation 3 are wherein at least a portion of the benzene fraction is converted to cyclohexane.

14. The process of claim 2 wherein the benzene-rich stream from step (d) is passed to a hydrogenation zone wherein at least a portion of the benzene fraction 1s converted to cyclohexane.

15. The process of claim 1 wherein the adsorption zone is run in a mode selected from fixed bed, simulated moving bed, and magnetically stabilized bed.

16. The process of claim 5 wherein the adsorption zone is run in a mode selected from fixed bed, simulated moving bed, and magnetically stabilized bed.

* * * * *